United States Patent [19]

Klemm

[11] 4,005,669

[45] Feb. 1, 1977

[54] MAST DISPLACEMENT MECHANISM

[76] Inventor: Julius Roland Klemm, 408 NE. 28 Road, Boca Raton, Fla. 33432

[22] Filed: Apr. 28, 1975

[21] Appl. No.: 572,123

[52] U.S. Cl. ..... 114/91; 114/39

[51] Int. Cl.[2] ..... B63B 15/00

[58] Field of Search ..... 114/91, 124, 39, 143

[56] References Cited

UNITED STATES PATENTS

| | | | |
|---|---|---|---|
| 241,037 | 5/1881 | Lyman | 114/91 |
| 559,983 | 5/1896 | McLean | 114/91 |
| 1,213,579 | 1/1917 | Bonom | 114/91 |
| 1,853,069 | 4/1932 | Minorsky | 114/124 |
| 1,916,459 | 7/1933 | Blackman | 114/91 |
| 3,099,976 | 8/1963 | Schwaneke et al. | 114/91 |
| 3,827,386 | 8/1974 | Faden | 114/91 |

*Primary Examiner*—Trygve M. Blix
*Assistant Examiner*—Charles E. Frankfort

[57] ABSTRACT

A mast displacement mechanism for a vessel having a hull and an upstanding mast comprising a cradle supported by the hull and defining track structure of a radius of curvature of a first predetermined length, a carriage movable with respect to said track structure and limit structure to limit movement of the carriage, structure on the carriage to connect to the mast at about the hull level for movement of the lower end of the mast together with the carriage relative to the track and lock structure to lock the carriage in a selected position with respect to said track structure for tilting the mast.

3 Claims, 9 Drawing Figures

MAST DISPLACEMENT MECHANISM

FIELD OF THE INVENTION

This invention relates to sailboats and, more particularly, to a mast displacement mechanism for sailboats.

BACKGROUND OF THE INVENTION

In the past there have been numerous types of mechanisms for displacing a mast, that is, tilting it with respect to the deck. Representative patents in the prior art are U.S. Pat. Nos. 241,037; 273,529, 641,321, 1,039,122. The present invention is of an improvement generally speaking in the art of moving a mast to tilt it about a pivot point high on the mast with the low end being guided to the left and right by a track means through a carriage interconnection which includes lock means to lock it in a selected position. Other prior art patents are U.S. Pat. Nos. 3,323,480, 3,099,976; 3,085,539; 2,353,007; 830,720, 559,983, 457,323, and 236,037. This invention is of a sailboat which does not pivot the mast around a point at or near the deck level which is typical of prior art mechanisms some of which are self-centering, some of which are counterbalanced, and some of which are adjustable while "underway."

A distinguishing feature of the instant invention is that the pivot for the tilt of the mast is located at the upper end zone of the mast, as a pendulum, and the lower deck end of the mast is moved through an arc, guided by the track means along a radius of curvature between the pivot and the track means and the invention also provides as described hereinafter means for positioning the mast and means for clamping or holding the position once selected. This invention provides simplicity of the rigging which does not alter in length with movement of the mast and is suitable for installation in light inexpensive recreational boats of various types as well as being adaptable for use with heavy cruising and racing type craft.

It is, accordingly, an object of this invention to provide a mast displacement mechanism to provide an ability for a sailboat to point closer to the wind, to better utilize hull forms and to minimize list under varying wind conditions. It is also an object to provide a sailboat which is provided with a mast displacement mechanism to more effectively utilize wind forces relative to the sail position under varying wind intensities and which is safe due to controllable balance of the vessel with the mast and sail, when tilted to a correct position, acting as an adjustable ballast.

It is a further object of this invention to provide a mast mechanism which provides for movement of a mast in the process of "coming about," or changing direction in a turn. Generally speaking it is an object to provide a mast displacement mechanism which provides for simplicity of rigging and the ability to use the mast itself as a type of stabilizer or ballast for more effective utilization of wind under varying conditions.

In accordance with these and other objects which will become apparent hereinafter the instant invention will now be described with reference to the accompanying drawing in which:

DESCRIPTION OF THE DRAWINGS

Figure 2:
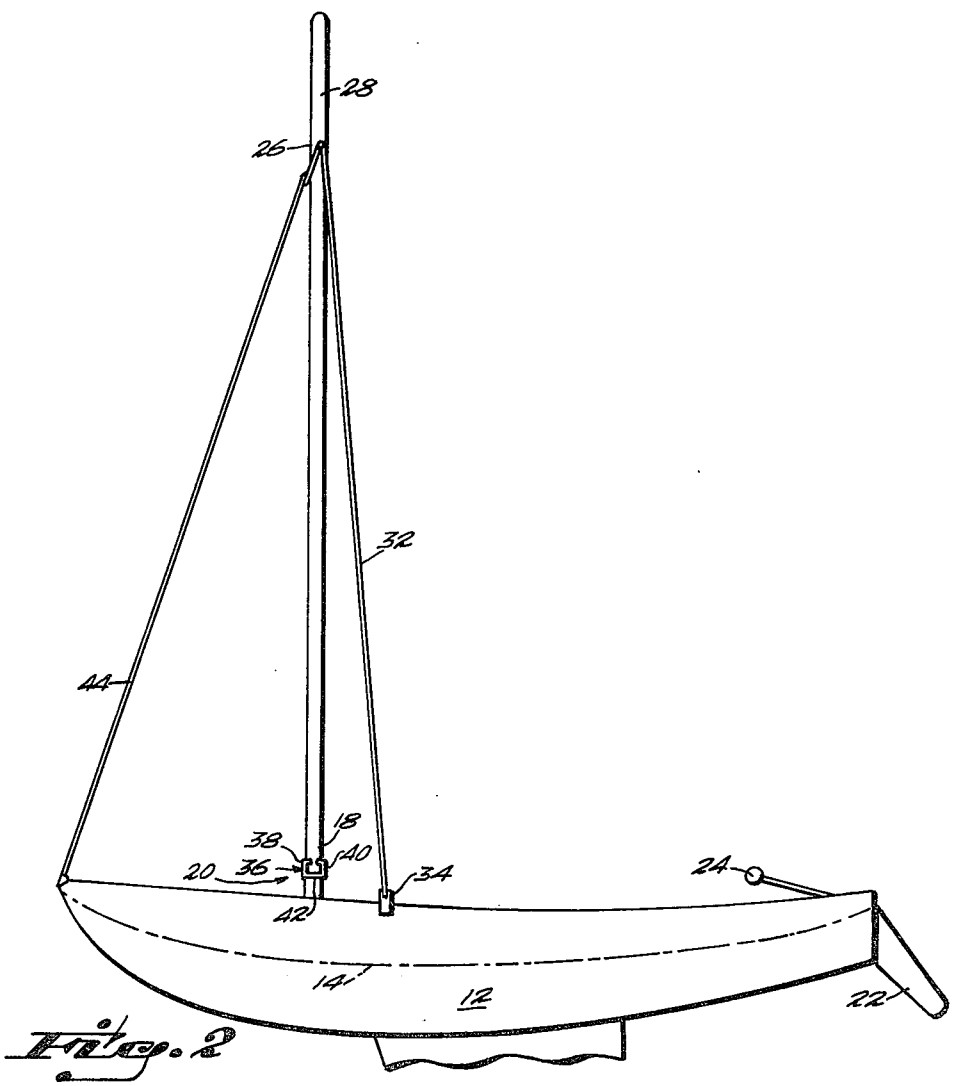
FIG. 2 is a side elevation view of the boat shown in FIG. 1.
Figure 1:
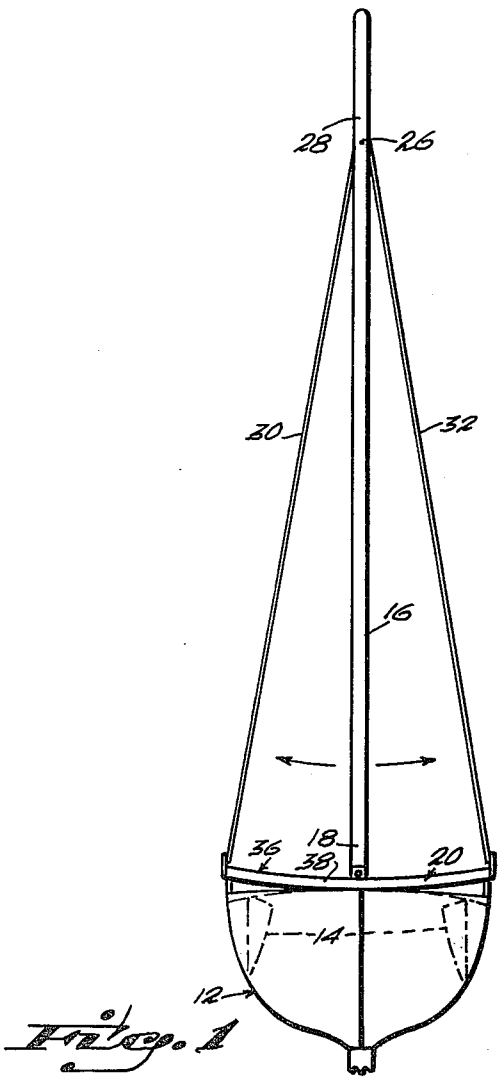
FIG. 1 is a front elevation view of a sailboat provided with the instant invention.

Referring to the drawings wherein like reference characters designate like or corresponding parts throughout the several views there is shown a hull 12, which may be in the form of a catamaran, as suggested by the dotted line portion of FIG. 1 and indicated by the numeral 14. In any event extending upwardly from the hull means a mast 16 is provided which, at its lower end 18, is connected to a track means 20 which in the embodiment shown is transverse or athwart. The boat is equipped with a conventional rudder means 22 and operator 24. For purposes to be described hereinafter a pivot point 26 is located in the upper zone 28 of the mast 16 from which cables 30 and 32 extend downwardly to a pulley 34. The track means is of channel form as seen in FIG. 2 at 36 including side flanges 38 and 40 and a lower web or floor 42. Referring to FIG. 1 there is also provided a forestay cable 44.

Figure 3:
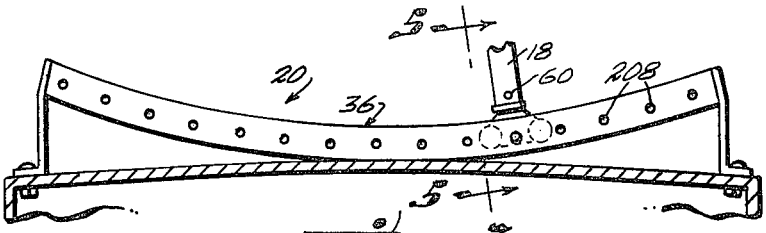
FIG. 3 is a view partly in cross section of the lower end of the mast and the deck of the boat.
Figure 4:
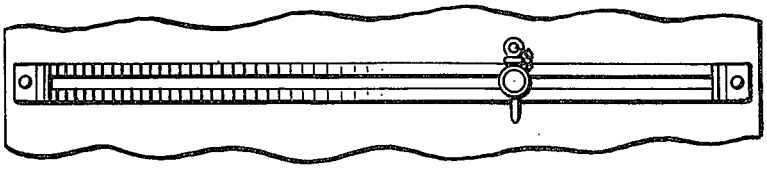
FIG. 4 is a plan view of FIG. 3.
Figure 6:
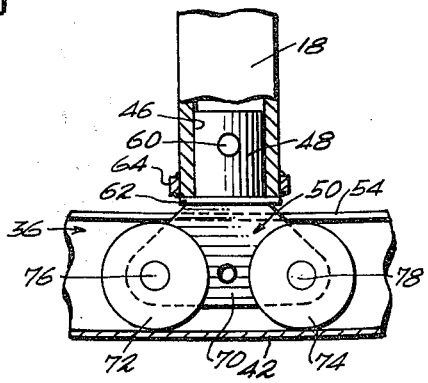
FIG. 6 is a view in cross section taken on the plane indicated by the line 6—6 of FIG. 5 and looking in the direction of the arrows.
Figure 7:
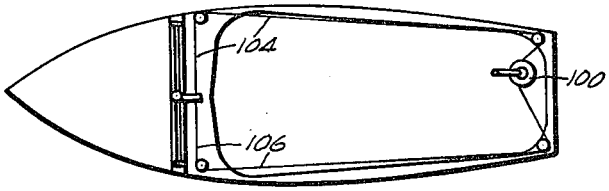
FIG. 7 is a plan view of a boat equipped with the instant invention and showing an operator for the mast displacement mechanism.

Referring to FIG. 6 the lower end 18 of the mast is provided with a recess 46 which is sized to receive an upstanding stem 48 of a carriage 50 which is movable within the channel of the track means being captivated therein by inturned upper portions 52 and 54 on the flanges 38 and 40. Aligned pin and hole means indicated by the numeral 60 are provided to connect the stem in the recess of the lower end of the mast and stop means are provided to limit penetration of the stem such as that designated by the numeral 62. A step 64 may be provided on the lower end of the mast. In the preferred embodiment the carriage comprises a body 70 with a first and a second pair of wheels 72 and 74 each pair having a common axle 76 and 78. It is thus seen that the lower end of the mast as seen in FIG. 3 may be travelled through its connection with the carriage along the path of the track means which is effective to constrain the carriage to a path of movement of a radius of curvature equal to the distance between the pivot point 26 of the mast and the web 42 of the track means. Means are provided for moving the carriage and in a first embodiment these means comprise a cable actuated system, see FIG. 7 with a wheel and drum 100 at the stern of the cockpit or other suitable position withith the boat. It is thus seen that by operating the hand wheel and drum mechanism 100 the forces will be transmitted to the carriage through the cables 104 and 106 to move it with respect to the track means to a desired location for tilting the mast.

Figure 8:
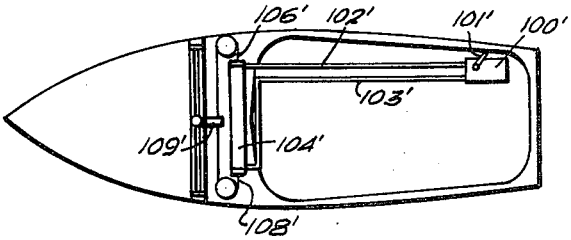
FIG. 8 is a view similar to FIG. 7 and showing an alternative operator means for the mast displacement mechanism.

Alternative means such as that shown in FIG. 8 may be provided in which a pump reservoir unit 100' with an operator 101° is connected through piping 102' and 103' to a hydraulic cable cylinder 104' which operates the cable as at 106' and 108' to transmit forces to move an extension 109' on the carriage and, hence, to move it along the track means to a predetermined location.

Figure 9:
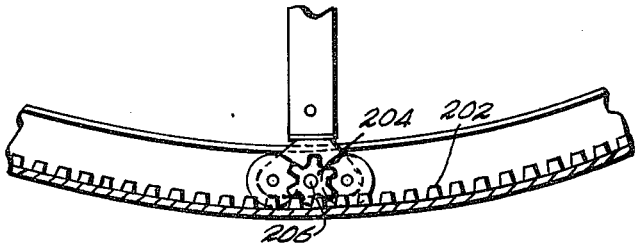
FIG. 9 is a view in cross section similar to a portion of FIG. 3 and illustrating a mechanical operator means in the form of a rack and pinion for displacing the lower end of the mast.

As a preferred embodiment a rack and pinion gear mechanism may be provided as shown in FIG. 9 in which the web of the track means supports a rack 202 the teeth of which are in engagement with a pinion gear 204 carried by an operator shaft 206 fixed to the body 70' so that by turning the gear 204 by means of the operator shaft 206 the mast will be displaced.

Figure 5:
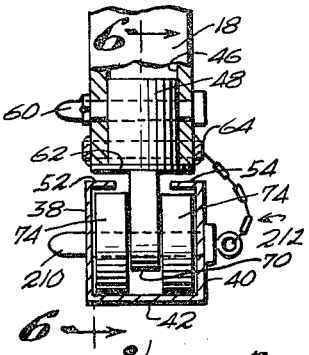
FIG. 5 is a view in cross section taken on the plane indicated by the line 5—5 of FIG. 3 and looking in the direction of the arrows.

It is thus seen that there is provided a sailboat with a mast displacement mechanism in which the mast is displacable or tiltable about a point in the upper ends, as would a pendulum, to swing the deck end of the mast or lower end of the mast along an arc, guided by a track means, and in which the lower end may be either mechanically or manually positioned and which includes some means for clamping or holding the lower end when the position has been achieved, which may be in the form of the plurality of holes 208 along the flanges in opposition to one another to receive the pin 210 of the lock means 212 as shown in FIGS. 3 and 5.

What is claimed is:

1. A mast displacement mechanism for a vessel having a hull and an upstanding mast with a lower end, said mechanism comprising:

a cradle supported by the hull and defining arcuate track means of a radius of curvature of a first predetermined finite length, a carriage movable with respect to said track means and limit means to limit movement of said carriage, means on the carriage to connect to the mast at about the hull level for movement of said lower end together with the carriage relative to the track;

lock means to lock the carriage in selected positions with respect to said track means for tilting the mast;

said carriage comprising a forward pair and a rearward pair of wheels captivated by said track means;

operator means effective to tilt the mast when said lock means is not restraining movement of the lower end of the mast; and said operator means comprising a plurality of teeth comprising a rack in said track means and a gear on said carriage in engagement with said rack including an operator shaft extending outwardly of said track and in engagement with said gear so that upon rotation of the gear the carriage will move with respect to said track means.

2. The device as set forth in claim 1 wherein said operator means comprises cable and pulley means for movement of said carriage in said track means.

3. The device as set forth in claim 1 wherein said operator means comprises hydraulically actuated cable cylinder means for movement of said carriage in said track means.

* * * * *